US010544937B2

(12) United States Patent
Falkenhayn et al.

(10) Patent No.: US 10,544,937 B2
(45) Date of Patent: Jan. 28, 2020

(54) LIQUID FUEL LIGHTER

(71) Applicant: EXOTAC, INC., Winder, GA (US)

(72) Inventors: Rob Falkenhayn, Hoschton, GA (US); Colin Reilly, Austin, TX (US)

(73) Assignee: Exotac, Inc., Winder, GA (US)

( * ) Notice: Subject to any disclaimer, the term of this patent is extended or adjusted under 35 U.S.C. 154(b) by 107 days.

(21) Appl. No.: 15/660,102

(22) Filed: Jul. 26, 2017

(65) Prior Publication Data

US 2018/0031235 A1 Feb. 1, 2018

Related U.S. Application Data

(60) Provisional application No. 62/369,426, filed on Aug. 1, 2016.

(51) Int. Cl.

| | |
|---|---|
| ***F23Q 2/50*** | (2006.01) |
| ***F23Q 2/06*** | (2006.01) |
| ***F23Q 2/40*** | (2006.01) |
| ***F23Q 2/42*** | (2006.01) |
| ***F23Q 2/44*** | (2006.01) |
| *F23Q 2/36* | (2006.01) |

(52) U.S. Cl.

CPC ..... *F23Q 2/50* (2013.01); *F23Q 2/06* (2013.01); *F23Q 2/40* (2013.01); *F23Q 2/42* (2013.01); *F23Q 2/44* (2013.01)

(58) Field of Classification Search

CPC ..... F23Q 2/50; F23Q 2/06; F23Q 2/40; F23Q 2/42; F23Q 2/44

USPC ..... 431/151, 142, 143, 146, 277, 344

IPC ..... F23Q 2/50,2/06, 2/36

See application file for complete search history.

(56) References Cited

U.S. PATENT DOCUMENTS

| | | | | | |
|---|---|---|---|---|---|
| 2,368,070 | A * | 1/1945 | Sandor | F23Q 2/06 | 431/124 |
| 2,426,853 | A * | 9/1947 | Aronson | F23Q 2/08 | 431/135 |
| 2,527,100 | A * | 10/1950 | Lohr | F23Q 2/06 | 431/142 |
| 2,847,843 | A * | 8/1958 | Greenhouse | F23Q 2/34 | 431/151 |
| 3,023,748 | A * | 3/1962 | Bruskin | E05B 17/0016 | 126/229 |
| 3,353,376 | A * | 11/1967 | Tackett | F23Q 2/02 | 431/150 |
| 3,963,413 | A * | 6/1976 | Lockwood | F23Q 2/163 | 431/276 |
| 4,371,331 | A * | 2/1983 | Lee | F23Q 2/50 | 431/151 |
| 6,902,392 | B2 * | 6/2005 | Johnson | F23Q 2/40 | 431/142 |

(Continued)

FOREIGN PATENT DOCUMENTS

| | | | | |
|---|---|---|---|---|
| GB | 253570 | A * | 6/1926 | F23Q 2/06 |
| JP | 2000055365 | A * | 2/2000 | |

*Primary Examiner* — Steven B McAllister
*Assistant Examiner* — Daniel E. Namay
(74) *Attorney, Agent, or Firm* — Eversheds Sutherland (US) LLP

(57) ABSTRACT

A lighter comprises a container that is configured to hold a liquid fuel, a cap attachable to a top portion of the container, a fuel cap attachable to a bottom portion of the container, a first watertight seal formed by a first sealing element between the cap and the container, and a second watertight seal formed by a second sealing element between the fuel cap and the container.

20 Claims, 4 Drawing Sheets

(56) References Cited

U.S. PATENT DOCUMENTS

| | | | | |
|---|---|---|---|---|
| 2008/0108004 | A1* | 5/2008 | Caruso | F23Q 2/32<br>431/253 |
| 2009/0068603 | A1* | 3/2009 | Smith | F23Q 2/42<br>431/13 |
| 2018/0031235 | A1* | 2/2018 | Falkenhayn | F23Q 2/50 |

* cited by examiner

LIQUID FUEL LIGHTER

CROSS-REFERENCE TO RELATED APPLICATIONS

The disclosure claims priority to and the benefit of U.S. provisional patent application No. 62/369,426, filed Aug. 1, 2016, which is incorporated herein in its entirety.

FIELD OF THE DISCLOSURE

The disclosure generally relates to liquid fuel lighters and more particularly relates to water-resistant/waterproof and/or wind-resistant/windproof liquid fuel lighters.

BACKGROUND

Lighters are commonly carried and used for various purposes, including, among other things, smoking, lighting barbeques, and starting campfires. Liquid fuel lighters (such as a Zippo®) do not create a water tight seal when closed, which allows water to seep into and lighter fluid to leak out the lighter. In such instances, the lighter may become unusable if the lighting mechanism becomes wet or damaged. It is also possible for the lighting mechanism to corrode if exposed to moisture for a period of time. A lighter may also lose its lighter fluid to evaporation even when not in use due to the lack of a seal.

Lighters that are typically used outdoors generally include some type of wind guard to allow lighting in windy conditions. It is common for these lighters to be difficult and messy to service.

SUMMARY

Some or all of the above needs and/or problems may be addressed by certain embodiments of the lighter disclosed herein. The lighter may include a container that is configured to hold a liquid fuel, a cap attachable to a top portion of the container, a fuel cap attachable to a bottom portion of the container, a first watertight seal formed by a first sealing element between the cap and the container, and a second watertight seal formed by a second sealing element between the fuel cap and the container.

Other features and aspects of the disclosure will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
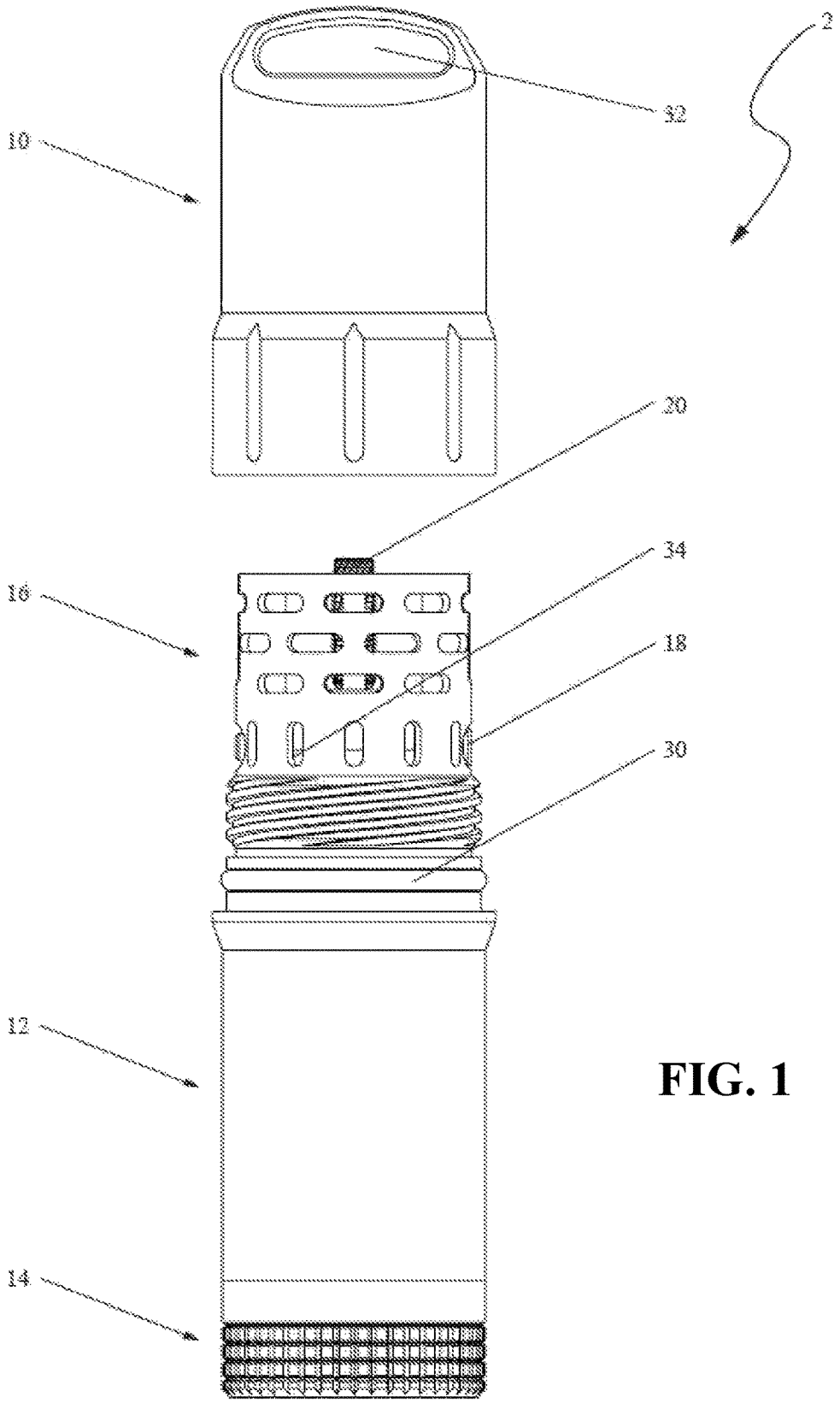
FIG. 1 depicts a partially exploded front view of a lighter in accordance with one or more embodiments of the disclosure.

The present disclosure is directed to a liquid fuel lighter that may create a watertight seal. The seal may prevent water from reaching the wick, lighting mechanism, and/or fuel storage. The seal also may prevent the liquid fuel and fuel vapor from leaking out of the lighter. For example, a seal may be created between the body of the lighter and the fuel cap using an O-ring. Likewise, a seal may be created between the body of the lighter and the top cap using another O-ring. The lighter disclosed herein may be much easier to service than traditional lighters and may prevent users from having to change the flint through the fuel compartment, which can result in the user getting liquid fuel on their fingers and hands.

In some instances, the body of the lighter may be broken into two parts: (1) the top assembly, which may include the wind guard and lighting mechanism; and (2) the bottom assembly, which may hold the fuel and wick. The flint and spring may be housed in-between the top and bottom assemblies, which may be held together by a removable pin that passes through both parts. In some instances, the flint can be changed through the removal of the pin and separation of the top and bottom assemblies.

The area around the hole in the fuel container that enables the wick to protrude may be cut away to allow air to flow up from underneath the wick from holes in the outer wind guard. This may allow the flame to get sufficient oxygen to burn while preventing the air from flowing too fast and blowing the flame out. In addition, the top cap may be attached to the body of the lighter, which may prevent both water from reaching the lighting mechanism and fuel drawn up from the wick from evaporating. The top cap also can include a hole through the top, which may allow the user to attach a lanyard or keychain.

Turning now to the drawings, FIGS. 1-4 depict a liquid fuel lighter 2. The liquid fuel lighter 2 may include a fuel container 12 that is configured to hold a liquid fuel therein. The container 12 may be any suitable size, shape, or configuration. Likewise, any suitable liquid fuel may be stored therein. The container 12 may be attached to a wind guard 16. The wind guard 16 may be any suitable size, shape, or configuration. The wind guard 16 may surround at least a portion of a lighting mechanism. A cap 10 can be screwed on/off of a top portion of the container 12 for storage and travel. When attached, the cap 10 may be disposed about the wind guard 16. The cap 10 may be any suitable size, shape, or configuration. Similarly, a fuel cap 14 can be screwed on/off of a bottom portion of the container 12 for refueling (i.e., filling the container 12 with liquid fuel). The fuel cap 14 may be any suitable size, shape, or configuration.

Figure 4:
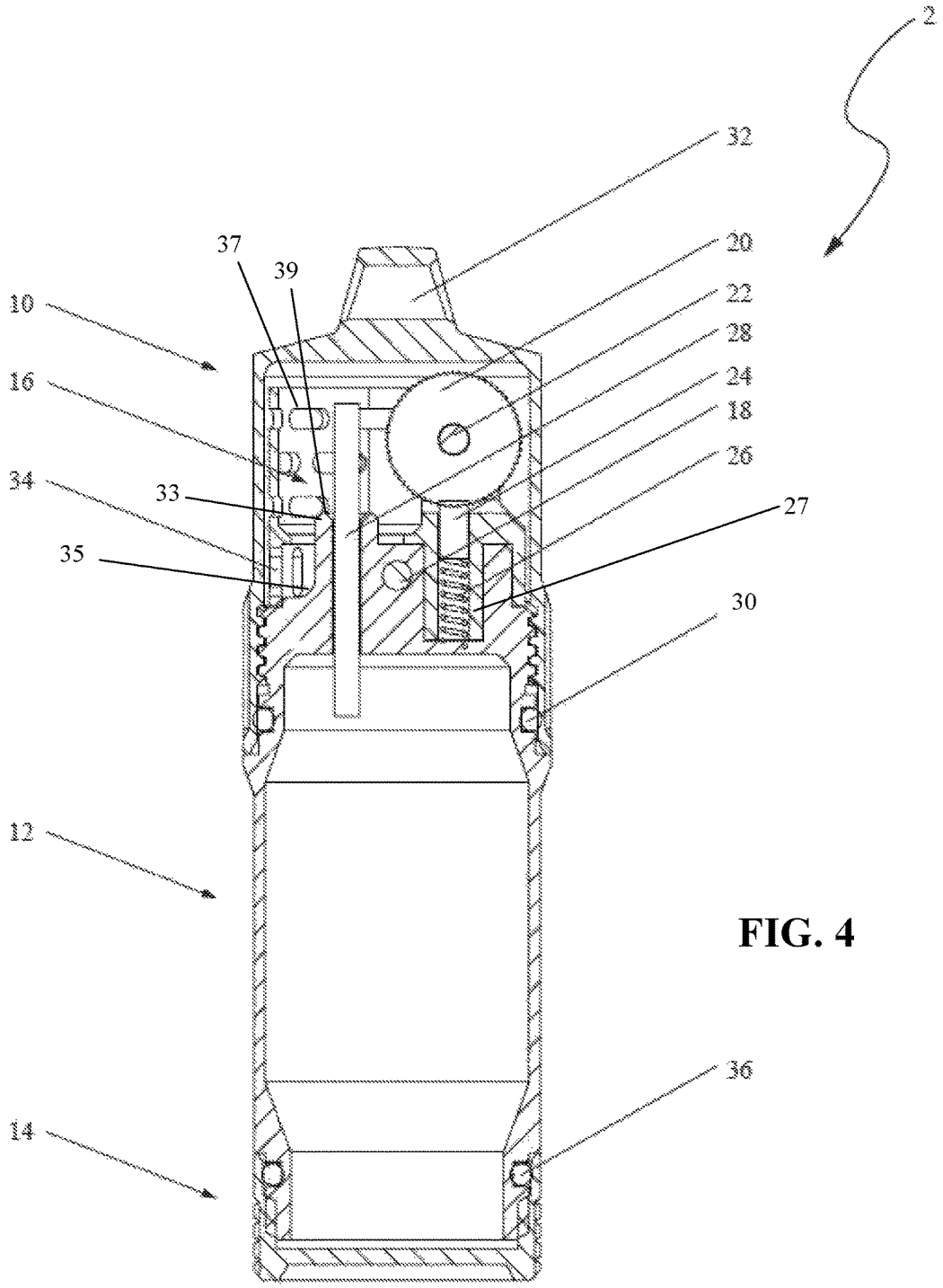
FIG. 4 depicts a cross-section of a lighter in accordance with one or more embodiments of the disclosure.

As depicted in FIG. 4, a first watertight seal may be created when the cap 10 is screwed onto the container 12, which may compress an O-ring 30 disposed between the cap 10 and the container 12. Similarly, a second watertight seal may be created when the fuel cap 14 is attached to the container 12, which may compress a fuel cap O-ring 36 disposed between the fuel cap 14 and the container 12. The O-ring 30 and the fuel cap O-ring 36 may comprise any suitable sealing material.

Figure 2:
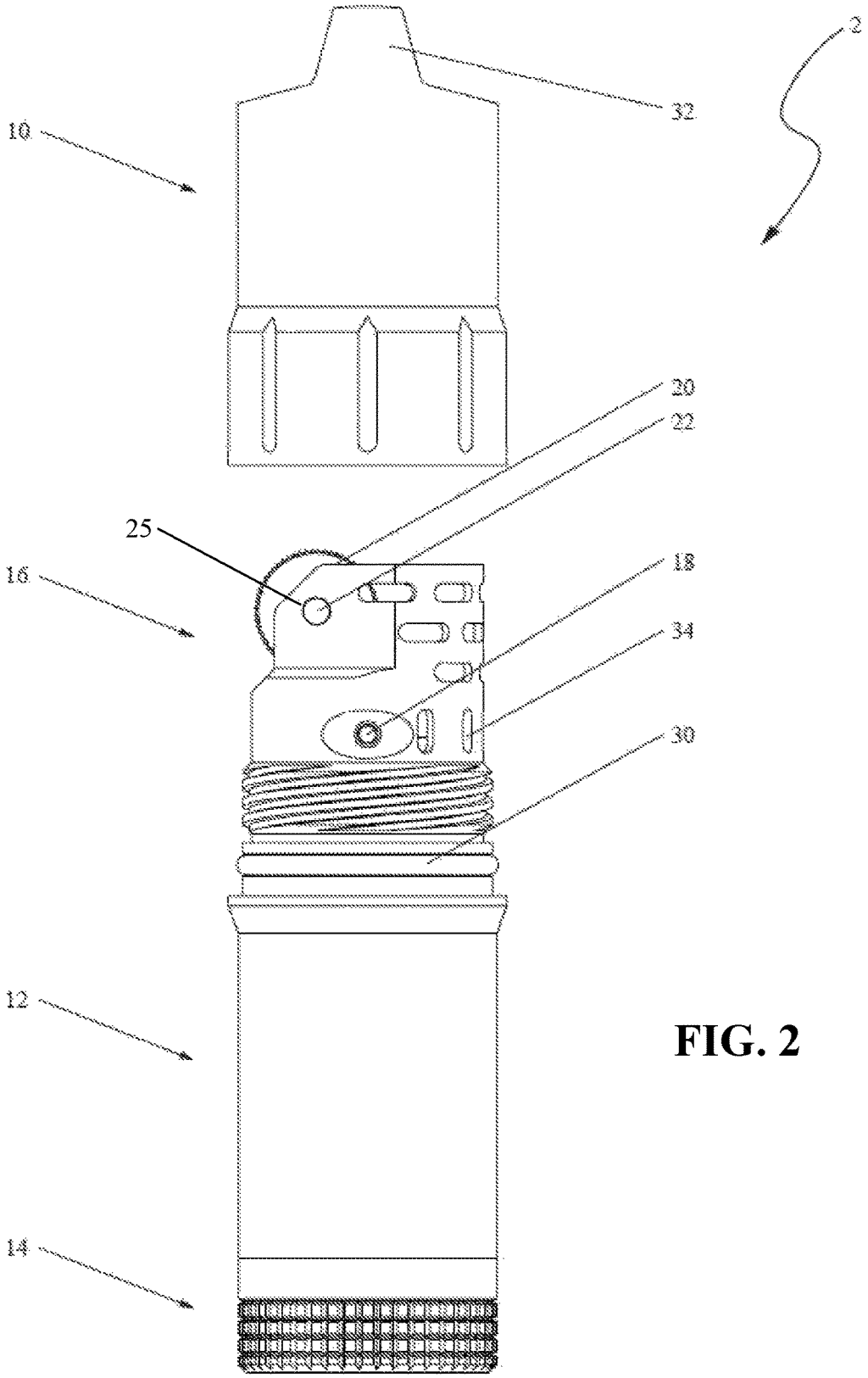
FIG. 2 depicts a partially exploded side view of a lighter in accordance with one or more embodiments of the disclosure.
Figure 3:
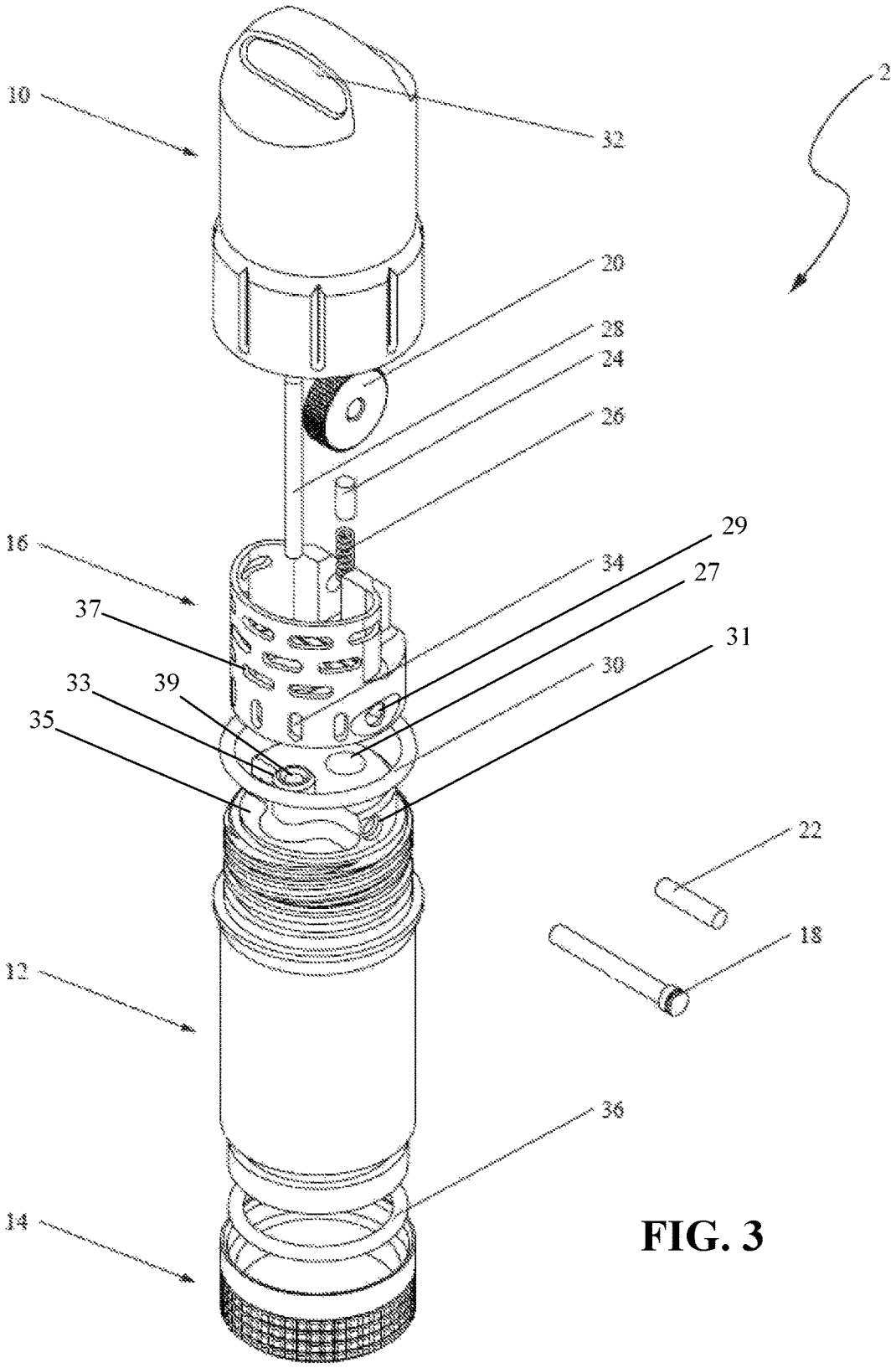
FIG. 3 depicts an exploded upper perspective view of a lighter in accordance with one or more embodiments of the disclosure.

As depicted in FIGS. 1-4, a lanyard attachment 32 may be integrally formed within the cap 10. As depicted in FIG. 2, when the cap 10 is removed from the container 12, the lighting mechanism may be exposed. As depicted in FIGS. 3 and 4, the lighting mechanism may include, among other things, a friction wheel 20, a flint 24, and a spring 26. The friction wheel 20 may be attached to the wind guard 16 by a friction wheel pin 22, which may pass though both the friction wheel 20 and a hole 25 (as depicted in FIG. 2) in the wind guard 16. The friction wheel pin 22 may enable the friction wheel 20 to freely rotate thereabout.

Turning back to FIGS. 3 and 4, a cavity 27 in the container 12 may be located beneath the friction wheel 20. The flint 24 and the spring 26 may be at least partially located in the cavity 27. For example, the spring 26 may be disposed at least partially around and/or beneath the flint 24 in the cavity 27 so as to exert a force upon the flint 24. In this manner, the flint 24 may be pushed up by the spring 26, which may cause the flint 24 to engage the friction wheel 20. The flint 24 and spring 26 may be captured between the cavity 27 in the container 12 and the friction wheel 20.

The wind guard 16 may be attached to the container 12 by an assembly pin 18 that passes through a hole 29 in the wind guard 16 and a hole 31 in the container 12. The assembly pin 18 may be removable for removing the wind guard 16 from the container 12 and replacing the flint 24.

A wick 28 may pass from inside of the container 12, through a hole 39 in a protrusion 33 in a top portion of the container 12, and through a hole in the bottom of the wind guard 16. In this manner, a bottom portion of the wick 28 may be positioned within the container 12, while a top portion of the wick 28 may sit inside of the wind guard 16 adjacent to the friction wheel 20 and flint 24. For example, the flint 24 and the friction wheel 20 may be positioned about the wick 28 such that when the friction wheel 20 is spun, sparks are created, which are directed at the wick 28.

The wind guard 16 may surround the wick 28 and include multiple oxygen holes 34. The oxygen holes 34 may be any suitable size, shape, or configuration. The oxygen holes 34 may be configured to allow oxygen to reach the flame but prevent wind from blowing the flame out. In some instances, the oxygen holes 34 may be located below a plane where the wick 28 protrudes from the container 12 to increase the flow of oxygen without increasing the risk of wind being able to blow the flame out. For example, the area around the protrusion 33 in the top portion of the container 12 that enables the wick 28 to protrude into the wing guard 16 may be cut away to form a void 35 to allow air to flow up from underneath the wick 28 from the oxygen holes 34 in the wind guard 16. This may allow the flame to get sufficient oxygen to burn, while preventing the air from flowing too fast and blowing the flame out.

In addition to the oxygen holes 34, the wing guard 16 may include a number of flame guard slots 37. Like the oxygen holes 34, the flame guard slots 37 may provide protection from the wind while still enabling oxygen to reach the flame. The flame guard slots 37 may be any suitable size, shape, or configuration. In some instances, the flame guard slots 37 may be omitted.

The cap 10, container 12, fuel cap 14, wind guard 16, friction wheel pin 22, and assembly pin 18 may be made of metal or other non-flammable, heat resistant, durable materials. In some instances, the fuel cap O-ring 36 and cap O-ring 30 may be made of an elastic plastic material, which is resilient enough to create a seal when compressed between two hard bodies but durable enough for many uses. The O-rings should also be resistant to degradation in the presence of liquid fuel. Any suitable material may be used for any of the components.

The advantages of the lighter disclosed herein include, without limitation, the ability to carry the lighter without the liquid fuel evaporating when not in use. In addition, the lighter may prevent water or moisture from entering the cavity containing the liquid fuel and lighting mechanism. The lighter also may keep the components of the lighter in a water tight enclosure. In this manner, the lighter components, which may be susceptible to corrosion, may be kept free from moisture and humidity in the air. In addition, the components of the lighter may be kept dry in the case where the lighter may become wet while in a pocket or backpack. An additional benefit of the lighter includes the ability to attach the lighter to a keychain or lanyard for easier transportation. Moreover, the lighter may be easier to service than traditional lighters when replacing the flint. Furthermore, the lighter provides improved wind resistance via the location and positioning of the oxygen holes in the wind guard. In this manner, the lighter is a waterproof lighter that protects all important components from moisture and damage, keeps the liquid fuel from escaping when not in use, and allows for improved serviceability and wind resistance.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A lighter, comprising:

a container that is configured to hold a liquid fuel, the container comprising a first threaded end and a second threaded end;

a cap attachable to a top portion of the container;

a fuel cap attachable to a bottom portion of the container;

a wind guard coupled to the container via a removable assembly pin, the wind guard comprising a plurality of oxygen holes;

a void defined by an upper horizontal surface of the first threaded end, a vertical wall defining a surface of a protrusion, and the wind guard, wherein the void is disposed between the protrusion and the wind guard, wherein the void is in communication with oxygen through the plurality of oxygen holes;

a first watertight seal formed by a first sealing element between the cap and the container; and a second watertight seal formed by a second sealing element between the fuel cap and the container.

2. The lighter of claim 1, further comprising a lanyard attachment integral to the cap.

3. The lighter of claim 1, further comprising a lighting mechanism disposed within the wind guard.

4. The lighter of claim 3, wherein the lighting mechanism comprises a friction wheel, a flint, and a spring, wherein the friction wheel is attached to the wind guard by a friction wheel pin, which passes through both the friction wheel and the wind guard and allows the friction wheel to freely rotate about the friction wheel pin.

5. The lighter of claim 4, further comprising a cavity in the container located beneath the friction wheel, wherein the flint and spring are located in the cavity, wherein the flint is pushed up by the spring and engages the friction wheel.

6. The lighter of claim 5, wherein the flint and spring are captured between the cavity in the container and the friction wheel.

7. The lighter of claim 4, further comprising a wick passing from inside of the container, through the protrusion in a top portion of the container, and through a hole in the bottom of the wind guard such that a top portion of the wick sits inside of the wind guard, wherein the flint and friction wheel are positioned adjacent the wick such that when the friction wheel is spun, sparks are created, which are directed at the wick.

8. The lighter of claim 7, wherein the wind guard surrounds the wick.

9. The lighter of claim 8, wherein the oxygen holes are located below a plane where the wick protrudes from the container.

10. The lighter of claim 1, wherein the wind guard is attached to the container by the assembly pin that passes through a hole in the wind guard and the container.

11. A lighter, comprising:

a container, the container comprising a first threaded end and a second threaded end;

a wind guard attachable to the container, the wind guard comprising a plurality of oxygen holes;

a void defined by an upper horizontal surface of the first threaded end, a vertical wall defining a surface of a protrusion, and the wind guard, wherein the void is disposed between the protrusion and the wind guard, wherein the void is in communication with oxygen through the plurality of oxygen holes; and a lighting mechanism disposed within the wind guard, wherein the lighting mechanism comprises a friction wheel, a flint, and a spring, wherein the friction wheel is attached to the wind guard by a friction wheel pin, which passes though both the friction wheel and the wind guard and allows the friction wheel to freely rotate about the friction wheel pin.

12. The lighter of claim 11, further comprising a cavity in the container located beneath the friction wheel, wherein the flint and spring are located in the cavity, wherein the flint is pushed up by the spring and engages the friction wheel.

13. The lighter of claim 12, wherein the flint and spring are captured between the cavity in the container and the friction wheel.

14. The lighter of claim 11, further comprising a wick passing from inside of the container, through the protrusion in a top portion of the container, and through a hole in the bottom of the wind guard such that a top portion of the wick sits inside of the wind guard, wherein the flint and friction wheel are positioned adjacent the wick such that when the friction wheel is spun, sparks are created, which are directed at the wick.

15. The lighter of claim 14, wherein the wind guard surrounds the wick and has multiple oxygen holes.

16. The lighter of claim 15, wherein the oxygen holes are located below a plane where the wick protrudes from the container.

17. The lighter of claim 11, wherein the wind guard is attached to the container by an assembly pin that passes through a hole in the wind guard and the container.

18. A lighter, comprising:

a container that is configured to hold a liquid fuel, the container comprising a first threaded end and a second threaded end;

a cap attachable to a top portion of the container;

a fuel cap attachable to a bottom portion of the container;

a first watertight seal formed by a first O-ring between the cap and the container;

a second watertight seal formed by a second O-ring between the fuel cap and the container;

a wind guard attachable to the container, the wind guard comprising a plurality of oxygen holes;

a void defined by an upper horizontal surface of the first threaded end, a vertical wall defining a surface of a protrusion, and the wind guard, wherein the void is disposed between the protrusion and the wind guard, wherein the void is in communication with oxygen through the plurality of oxygen holes;

a lighting mechanism disposed within the wind guard, wherein the lighting mechanism comprises a friction wheel, a flint, and a spring, wherein the friction wheel is attached to the wind guard by a friction wheel pin, which passes though both the friction wheel and the wind guard and allows the friction wheel to freely rotate about the friction wheel pin; and a cavity in the container located beneath the friction wheel, wherein the flint and spring are located in the cavity, wherein the flint is pushed up by the spring and engages the friction wheel, wherein the flint and spring are captured between the cavity in the container and the friction wheel.

19. The lighter of claim 18, further comprising a wick passing from inside of the container, through the protrusion in a top portion of the container, and through a hole in the bottom of the wind guard such that a top portion of the wick sits inside of the wind guard, wherein the flint and friction wheel are positioned adjacent the wick such that when the friction wheel is spun, sparks are created, which are directed at the wick, wherein the wind guard surrounds the wick, wherein the plurality of oxygen holes are located below a plane where the wick protrudes from the container.

20. The lighter of claim 18, further comprising:

a first hole disposed on the wind guard;

a second hole disposed on the container; and a removable assembly pin slotted through the first hold and the second hole.

* * * * *